United States Patent [19]

Hernandez

[11] 4,390,436

[45] Jun. 28, 1983

[54] AQUEOUS FILM FORMING LUBRICANT USEFUL IN A METHOD FOR DRAWING ALUMINUM AND OTHER SOFT METALS

[75] Inventor: Pablo M. Hernandez, Waukegan, Ill.

[73] Assignee: S. C. Johnson & Son, Inc., Racine, Wis.

[21] Appl. No.: 346,711

[22] Filed: Feb. 8, 1982

[51] Int. Cl.[3] ..... C10M 1/06

[52] U.S. Cl. ..... 252/49.3; 72/42; 252/49.5

[58] Field of Search ..... 252/49.3, 49.5; 72/42

[56] References Cited

U.S. PATENT DOCUMENTS

| | | | |
|---|---|---|---|
| 1,948,194 | 2/1934 | Williams | 252/49.5 X |
| 2,276,453 | 3/1942 | Bandur | 252/49.5 X |
| 2,374,565 | 4/1945 | Roden | 252/49.3 X |
| 2,524,017 | 9/1950 | Hance et al. | 252/49.5 X |
| 2,753,305 | 7/1956 | Whitbeck | 252/49.3 X |
| 3,065,174 | 11/1962 | Blake et al. | 252/49.5 X |
| 3,600,310 | 8/1971 | Eyres et al. | 252/49.5 X |
| 3,923,671 | 12/1975 | Knepp | 252/49.5 |
| 4,235,794 | 11/1980 | Rieber et al. | 252/32 X |
| 4,260,502 | 4/1981 | Slanker | 252/48.6 |

FOREIGN PATENT DOCUMENTS

| | | | |
|---|---|---|---|
| 1367525 | 5/1963 | France | 252/49.5 |
| 1459826 | 12/1976 | United Kingdom . | |
| 1522237 | 9/1979 | United Kingdom . | |
| 1522238 | 9/1979 | United Kingdom . | |

*Primary Examiner*—Andrew Metz

[57] ABSTRACT

In an improved method of forming containers from soft metals comprising coating the metal with a lubricant, forming a cup, drawing the cup and removing the lubricant, wherein the lubricant includes a compound with a melt point less than 65° C., a wax with a melt point less than 50° C., a fatty acid, an amine, thickener and water.

3 Claims, No Drawings

AQUEOUS FILM FORMING LUBRICANT USEFUL IN A METHOD FOR DRAWING ALUMINUM AND OTHER SOFT METALS

BACKGROUND OF THE INVENTION

This invention relates to a method of drawing and ironing aluminum and other soft, non-ferrous metals. More particularly, this invention relates to a drawing and ironing method for producing deep drawn aluminum containers, such as beverage containers using an aqueous film forming lubricant.

U.S. Pat. No. 4,262,057 describes a dry film metal drawing compound containing a borate, water and a sodium soap. Although this composition is indicated as being suitable for use in aluminum can drawing, it does not describe compositions similar to those set forth in the instant application.

U.S. Pat. No. 4,260,502 describes a synthetic drawing and ironing lubricant including a low molecular weight polyisobutylene, polyethylene glycol dioleate, a fatty acid soap and a phosphate compound. Again, the compositions set forth in this patent are different from those suitable for use in the method of the present invention and require the presence of a particular low molecular weight polyisobutylene. Furthermore, the method of the present invention has superior lubricating properties compared to the lubricants described in this patent.

U.S. Pat. No. 3,923,671 describes a metal working lubricant which can be used throughout all phases of the metal working process, including as a hydraulic fluid press fluid, stamping fluid, drawing and ironing fluid. This product contains nonionic surfactants and mineral oil. It is desirable for environmental considerations not to utilize mineral oil so as to facilitate easy clean-up and waste disposal.

British Pat. No. 1,459,826 describes a metal working composition, including an amine salt of tall oil, a nonionic surfactant, methyl lardate, biocides, corrosion inhibitor and water. This composition is substantially different than the compositions set forth and used in the method of the present invention.

U.K. Pat. Nos. 1,552,237 and 1,552,238 describe the method of forming hollow coated bodies comprising a step of spreading the coating material on the drum surface of the work piece prior to drawing. The method of the present invention does not require the use of any special apparatus other than that contained in a normal can forming line.

The method of the present invention is particularly desirable in that a single coating composition can be utilized at a relatively low coating weight to quickly and easily form drawn aluminum and other soft metal articles. The method uses an aqueous film former as the lubricant. The method allows beer and beverage containers to be formed at a lower draw force, tooling build-up and having better overall cup suitability. Furthermore, the hold-down pressure which can be achieved in the method of the present invention is substantially higher than those attained using the prior art methods.

BRIEF DESCRIPTION OF THE INVENTION

The present invention comprises a method of forming soft metal containers such as aluminum, brass, copper and copper alloy containers comprising applying a coating composition to the metal, said composition comprising from 1 to 10% by weight of a composition having a melting point less than 50° C. selected from the group consisting of lanolin, petrolatum and mixtures thereof; from 5 to 20% by weight of a wax having a melting point of less than 65° C., selected from paraffin waxes, castor wax, bees wax and mixtures thereof; from 1 to 10% by weight of a fatty acid selected from the group consisting of stearic acid, oleic acid, tall oil acid, ricinoleic acid, palmitic acid, myristic acid, lauric acid, isostearic acid and mixtures thereof; from 0.25 to 5% by weight of an amine selected from morpholine, diethyl amino ethanolamine, substituted morpholines and other amines; 0.1 to 2% by weight of a cellulosic thickener selected from hydroxyethyl cellulose, hydroxymethyl cellulose and mixtures thereof and water as the balance of the composition, said composition being applied at a coating weight of from 10 to 40 mg. per square foot, forming a cup of said metal utilizing a hold-down pressure of up to 2,500 psi.; forming a container by drawing said cup and removing said composition from said formed container.

OBJECTS AND ADVANTAGES OF THE METHOD OF THE PRESENT INVENTION

The primary object of the present invention is to provide an improved method for forming soft metal containers such as aluminum beer and beverage containers.

A further object of the present invention is to provide a method which can utilize a relatively low coating weight of lubricant to form drawn aluminum and soft metal containers.

A further object of the present invention is to provide a method which can provide high quality soft metal containers with a minimum of cup and drawing failures.

A still further object of the present invention is to provide a method which allows for the formation of a drawn aluminum beer and beverage container with minimum tear-off, low scoring, low earing and low tearing.

A still further object of the present invention is to provide a method for forming soft metal containers using an aqueous-based film forming lubricant.

Still further objects and advantages of the method of the present invention will become more apparent from the following more detailed description thereof.

DETAILED DESCRIPTION OF THE INVENTION

The method of the present invention comprises coating a lubricant on a soft metal to be drawn at a coating weight of from 10 to 40 mg. per square foot, forming a cup from said soft metal at a hold-down pressure of up to 2,500 psi.; drawing said cup to form the container and removing said coating, the improvement which comprises utilizing as the coating a composition comprising from about 1 to 10% by weight of a compound having a melt point of less than 50° C. selected from the group consisting of lanolin, petrolatum and mixtures thereof; from about 5 to 20% by weight of a wax having a melt point of less than 65° C. selected from paraffin wax, hydrogenated castor wax, bees wax and mixtures thereof; from about 1 to 10% by weight of a fatty acid; from about 0.25 to 5% by weight of an amine selected from the group consisting of morpholine, diethyl amino ethanolamine, substituted morpholines and mixtures thereof; from about 0.1 to 2% by weight of a thickener and the balance of the composition comprising water.

The method of the present invention utilizes drawing and ironing conditions to produce soft metal containers of high quality. Suitable soft metals for use in the method of the present invention include aluminum, aluminum alloys, copper, brass and other copper alloys. The preferred metal for use in the method of the present invention is aluminum. Typically, the aluminum and other soft metals may be in any gauge suitable for use in forming the desired container. It is preferred to use metal of between 10 and 20 gauge.

The metal stock is coated with a cupping and/or drawing lubricant and then passed into a cupper to form a metal cup. This cup is then fed to the drawing dye which forms the ultimate container. Hold-down pressures utilized to form the cup range up to about 2,500 psi. During the drawing operation, tool pressure can be as high as 2,000 psi.

Proper cup formation is essential to the formation of satisfactorily drawn containers. If the cup has any defects such as scoring, earing, etc., these become apparent when the cup is later drawn to form the container.

Subsequent to the drawing and ironing to form the container, the coating composition is removed from the formed container utilizing a washing step. The particular washing equipment and compositions necessary to remove the coating depend upon the coating utilized. For the coatings used in the method of the present invention, standard acid or slightly alkaline cleaners utilized in the industry can remove these coating compositions.

The coating composition should be applied prior to the cupper and can be applied using any conventional coating method. One particularly preferred method is to use a roll coater which applies an aqueous coating to the aluminum stock about to enter the cupper. During the cupping operation, this coating can dry to a water-impervious film which can be easily removed in the subsequent cleaning operation. This film, however, during the cupping and ironing processes, provides sufficient lubrication to form desirable hig quality containers.

The composition includes as a first component a composition having a melting point of less than 50° C. Suitable materials include lanolin and petrolatum. Although any grades of lanolin and petrolatum can be utilized, it is preferred to utilize an anhydrous lanolin grade USP, as this material has a high degree of purity. Similarly, petrolatum should also be high purity petrolatum, although lower purity grades can successfully be utilized.

The preferred composition contains from about 2 to 5%, with the most preferred composition being about 2.5% by weight of a composition having a melting point of less than 50° C.

The composition also includes a wax having a melting point of less than 65° C. Suitable waxes include refined paraffin waxes of varying melting points and grades, hydrogenated castor wax, bees wax and other similar low melting waxes. Particularly preferred waxes are those refined paraffin waxes having a melting point of from 56° to 57° C. It is preferred to utilize the waxy component in an amount of from about 5 to 10% by weight, and preferably from about 5 to 7% by weight.

The compositions used in the methods of the present invention also include a fatty acid. Substantially and higher fatty acid can be used, such as stearic acid, oleic acid, tall oils, recinoleic acid, palmitic acid, myristic acid, lauric acid, isostearic acid and mixtures. Typically, commercially available fatty acids are sold with the designation of the prime or majority component. Therefore, a composition sold as stearic acid actually will contain some percentage of other fatty acids such as oleic acid, recinoleic acid, palmitic, isostearic and lauric acids. Typical fatty acids have from 12 to 18 carbon atoms in the acid chain and it is preferred that the fatty acids primarily comprise saturated fatty acids. Although a small percentage of unsaturated fatty acids can be present, it is most preferred to utilize a fatty acid having a substantial percentage, i.e., greater than 60%, stearic acid. Typically, the compositions of the present invention include from about 1 to 10% b weight of stearic acid, it is preferred that the compositions include from about 1 to 5% by weight of fatty acid, with the most preferred compositions being from about 2 to 3% by weight fatty acid.

The fatty acids form an amine soap in situ with various volatile amines. These amine soaps are known to have some lubricating properties and it is thought that, in combination with the wax, the fatty acid soaps provide these lubricating properties of the compositions of the present invention.

To form the fatty acid amine soaps, various volatile amines may be utilized, such as morpholine, diethyl amino ethanolamine, substituted morpholines and mixtures thereof. Typical compositions include from about 0.25 to 5% by weight of volatile amine, with preferred compositions including from about 0.25 to 1%, and the most preferred compositions containing about 0.5% by weight.

The compositions used in the methods of the present invention are primarily aqueous dispersions and include a substantial percentage of water. Typical compositions include from about 80 to 95% by weight water, although more concentrated products also can be prepared and later diluted upon use. Typically, the water forms a balance of the composition up to 100%.

The compositions used in the method of the present invention can also contain a variety of optional additive ingredients, such as corrosion inhibitors, bactericides, perfumes, preservatives and the like. These materials are present in very small amounts, generally in amounts of less than 1% each.

The coating should be removed to form a clean container. The aqueous coating applied in the present method is easily removable using conventional cleaning compositions and apparatus. Typical cleaning compositions are acidic or slightly basic. The acid cleaners often include hydrofluoric acid. A suitable cleaning system includes the PARCO Cold Cleaner 450 System from OXY Metal Industries. These cleaners can be applied by a variety of methods, including spraying, dipping, etc.

The method of the present invention will now be illustrated by way of the following examples. In these examples, all parts and percentages are by weight, all temperatures, unless otherwise indicated, are in degrees centigrade.

EXAMPLE 1

A composition having the following components was prepared:

| | |
|---|---|
| Water | 89.05% |
| Formaldehyde (37%) | 0.20% |
| Morpholine | 0.50% |
| Anhydrous Lanolin USP | 2.50% |
| refined Paraffin Wax | 5.00% |

-continued

| | |
|---|---|
| (56-57° C. Melt Point) | |
| Stearic Acid (Emersol 6320) | 2.50% |
| (Hydroxy Ethyl Cellulose (Natrosol 250H) | 0.25% |

Approximately 10 mg. per square foot of the above composition is roll-coated on 12 gauge aluminum sheet stock. This composition is fed an MTS Laboratory Cupping Press. The cup is formed using a hold-down pressure of up to 2,000 pounds per square inch and a punch pressure of up to 1,235 psi. The cups were then processed through a wall ironing machine to determine suitability for forming beer and beverage cans. These cups formed satisfactory containers of aluminum.

The coating composition was then removed using an aqueous acid cleaning composition such as PARCO Cold Cleaner 450 (14 pounds of PARCO Cold Cleaner 450 and 0.49 pounds of Accellerator 45 per 100 gallons of water). The cleaner is heated to 35°-40° C. and sprayed onto the aluminum container. The container is then washed with water to remove any residue.

EXAMPLE 2

The following composition was prepared:

| | |
|---|---|
| Lanolin USP | 2.50% |
| Refined Paraffin Wax 56-57° C. Melt Point | 5.00% |
| Stearic Acid (Emersol 6320) | 2.50% |
| Morpholine | 0.50% |
| (Hydroxy Ethyl Cellulose (Natrosol 250HHR) | 0.50% |

-continued

| | |
|---|---|
| Water | 88.90% |
| Tektamer 38 (Preservative) | 0.10% |

This composition was roll-coated onto 12.5-13 gauge Alcoa Aluminum stock with a heavy surface finish at 11mil. per square foot. This stock was passed into a cupping press and provided good quality cups with a low percentage of tearing, earing and scoring.

What I claim is:

1. In a method of forming containers from a soft metal comprising coating a lubricant on said metal at a coating weight of from about 10 to 40 mg. per square foot; forming a cup from said coated soft metal at a hold-down pressure of up to 2,500 psi.; drawing said cup to form a container; and removing said lubricant; the improvement which comprises using as said lubricant a composition comprising from about 1 to 10% by weight of a compound having a melt point of less than 50° C. selected from the group consisting of lanolin, petrolatum and mixtures thereof; from about 5 to 20% by weight of a wax having a melt point of less than 65° C. selected from paraffin wax, hydrogenated castor wax, bees wax and mixtures thereof; from about 1 to 10% by weight of a fatty acid; from about 0.25 to 5% by weight of an amine selected from the group consisting of morpholine, diethylamine ethanolamine, substituted morpholine and mixtures thereof; from about 0.1 to 2% by weight of a thickener and water comprising the balance.

2. The method of claim 1 wherein the soft metal is aluminum.

3. The method of claim 1 wherein the fatty acid is selected from the group consisting of stearic acid, oleic acid, tall oil, recinoleic acid, palmitic acid, myristic acid, lauric acid, isostearic acid and mixtures thereof.

* * * * *

UNITED STATES PATENT AND TRADEMARK OFFICE

CERTIFICATE OF CORRECTION

PATENT NO. : 4,390,436

DATED : June 28, 1983

INVENTOR(S) : Pablo M. Hernandez

It is certified that error appears in the above-identified patent and that said Letters Patent is hereby corrected as shown below:

In Column 3, Line 40, the word "hig" should read --high--.

In Column 3, Line 64, the word "and" should read --any--.

In Column 4, Line 12, the word "b" should read --by--.

In Column 6, Line 28, the word "diethylamine" should read --diethylamino--.

Signed and Sealed this

Fourth Day of September 1984

[SEAL]

*Attest:*

*Attesting Officer*

GERALD J. MOSSINGHOFF

*Commissioner of Patents and Trademarks*